US005816412A

United States Patent [19]

Bokor

[11] Patent Number: 5,816,412

[45] Date of Patent: Oct. 6, 1998

[54] SCREENING SYSTEMS AND METHODS FOR SCREENING PARTICULATE MATERIAL

[75] Inventor: Anton Bokor, Stutensee-Blankenloch, Germany

[73] Assignee: Western Wire Works, Inc., Portland, Oreg.

[21] Appl. No.: 630,422

[22] Filed: Apr. 2, 1996

[51] Int. Cl.[6] ..... B07B 1/36

[52] U.S. Cl. ..... 209/326; 209/332; 209/366.5; 209/395

[58] Field of Search ..... 209/325, 326, 209/331, 332, 393, 395, 364, 365.1, 366, 366.5, 367

[56] References Cited

U.S. PATENT DOCUMENTS

| | | | |
|---|---|---|---|
| 3,221,877 | 12/1965 | Dekoning | 209/314 |
| 3,241,671 | 3/1966 | Brauchla | 209/314 |
| 3,454,162 | 7/1969 | Cover | 209/314 |
| 4,956,078 | 9/1990 | Magerowski et al. | 209/395 X |
| 5,219,078 | 6/1993 | Hadden | 209/314 |
| 5,322,170 | 6/1994 | Hadden | 209/314 |

FOREIGN PATENT DOCUMENTS

| | | |
|---|---|---|
| A-631825 | 1/1995 | European Pat. Off. . |
| A-1322014 | 7/1973 | United Kingdom . |
| 2134415 | 8/1984 | United Kingdom . |
| A-2233582 | 1/1991 | United Kingdom . |
| A-2247850 | 3/1992 | United Kingdom . |

*Primary Examiner*—Janice L. Krizek
*Attorney, Agent, or Firm*—Marger Johnson McCollom & Stolowitz, P.C.

[57] ABSTRACT

The subject invention relates to a screening system, preferably a finger screening system, for screening particulate material. The screening system for screening particulate material comprises a screening assembly including a housing. A plurality of screening modules are mounted for direct attachment to and removal from the screening assembly. Each screening module comprises a support block having a front end and a back end and a plurality of rods joined at a first end to the front end of the support block. The second end of the rods are free of attachment and form a row of the rods extending outwardly from the support block. The row of rods define an array of sieve openings of a predetermined size for allowing particulate material up to a predetermined size to pass through the screening module. A plurality of attachment assemblies are also provided for clamping the plurality of screening modules to the screening assembly. Each attachment assembly comprises a first clamping member and second clamping member which are disposed for relative movement one with respect to the other. Clamping and unclamping of the screening modules within the screening assembly is implemented by moving at least one of the first clamping member and second clamping member along a path toward the rear of the screening assembly until the screening modules become interlockingly engaged by the first clamping member and second clamping member.

23 Claims, 4 Drawing Sheets

SCREENING SYSTEMS AND METHODS FOR SCREENING PARTICULATE MATERIAL

BACKGROUND OF THE INVENTION

The invention relates to systems and methods for screening particulate material, and more particularly to finger screening systems for screening particulate material.

Screening is the separation of particulate material into various sizes. Various conventional types of screens are used to separate particulate material including vibrating inclined, stationery inclined, vibrating grisly, vibrating horizontal, rotary and static.

The vibrating inclined screen is the most popular of the screen types. Types of vibrating screens include those with two and four bearings, high speed screens, and screens which vibrate at the natural frequency of selected spring clusters. The majority of aggregate producers utilize a two or three deck included vibrating screen with two bearings. The two bearing, circle throw, inclined screen utilizes a counter weight on a shaft to move the screen through approximately a ⅜ inch displacement throw. Screen throw varies inversely with the shaft speed with typical ranges from 800 to 950 rpm. The screen is isolated on springs and is customarily powered by an electric motor with a V-belt drive. Screen slopes vary from 15 to 30 for dry separations to slightly flatter for wet sieving.

The included vibrating screen is angularly adjustable to an inclined position to improve efficiency. Variations in slope, speed, stroke, and direction of rotation provide the flexibility required to determine the best combination of variables for making the separation. The inclined vibrating screen is typically used for aggregate separation. The addition of extra counterweights allow the screen to handle dense, coarse aggregate. When properly sized, the inclined vibrating screen performs virtually maintenance-free except for wear from the aggregate as it is processed. Horizontal screens are normally selected when conserving headroom or there is a need to maintain a lower profile. Variations in speed and stroke can be made for a given separation scheme.

The screening surface used in combination with a given vibrating screen must be strong enough to support the weight of the material, flexible enough to withstand the vibration, and provide enough open area to allow the desired throughput of aggregate. Various screening decks and screening elements are known for this purpose. One type of screening system particularly useful for applications typically plagued by binding problems, i.e., clogged screen surfaces from sizing materials with a high percentage of soil, roots, vines, plastic, demolition materials, etc., is a finger screening system. Finger screens are in particular used for sizing difficult screen feeds, which rapidly lead to screen clogging on conventional mesh screens. They are in particular used for the preliminary sizing of the screen feed, so as to separate adhering and optionally also smearing fine particles from the screen feed to be recovered. The particular types of problem screening materials which finger screening systems are designed to handle include topsoil, landfill material, recycling waste, compost, sand and gravel, and demolition debris.

As the rods are fixed in freely projecting manner on the bearing rail, due to the vibratory drive of such screeners they are exposed to considerable stresses under the load of the screen feed, particularly in the vicinity of their fixing to the bearing rail. In order to absorb these dynamic stresses and prevent the breaking of the fingers at the fixing point, it is known to elastically mount the rods on the bearing rail. In known screeners having this construction fastening means for the rods and/or the bearing rail pass between the rods, so that the latter must have a minimum spacing, which consequently also determines the undersize. The problem of the invention is to construct a screener so that the rod spacing can be chosen at random and can in particular be reduced compared with the known screens.

One known type of finger screening system is the Erin Matech Cascade apparatus manufactured and sold by Buffalo Wire Works Co., Inc. of Buffalo, N.Y. This system includes replaceable rods made of high carbon steel of differing diameter (depending on the desired diameter and slot opening requirements) which are inserted into a row of apertures, having a complimentary diameter to the diameter of the rods, located in one side of an elongate rectangular polyethylene rod block. The elongate rod block is compressibly retained within a U-shaped elongate channel defined by an elongate metal U-shaped channel member. Once in place, the channel member surrounds a substantial area at the side of the rod block. A plurality of U-shaped channel members, each containing elongate rod blocks with rods located in the apertures, are pivotally attached to a metal frame member system. In this way, the angle that the channel members, and in turn the rod block, and further in turn the row of horizontal rods, forms with the frame member, can be adjustably set.

The metal frame member system is designed to attach to the interior support members of a vibrating screen box. The vibrating screening boxes comprise a pair of vertically-extending sidewall members disposed in a vertical position in a parallel vertical plane. The rear vertically-extending edges of the sidewall members are joined one to the other by a verticallyextending rearwall member. The vibrating screening boxes are also held together by interior metal support members joined to the sidewalls and rearwall thereof. The metal frame member system including the rods and rod blocks which are non-integral but are instead designed to attach to the metal support frame members. Once the metal frame system, including the rod block and the rods, are in place and attached to the interior of the vibrating screen box, the screening process can be conducted.

The above-described finger screen system has a number of drawbacks. The metal frame member must be individually fabricated for vibrating screen boxes of differing shapes and dimensions, and for structural support members of differing configurations. This is a problem since some vibratory screen boxes have laterally-extending support members and some have longitudinally-extending support members. It is also a costly problem for end user who must stock differing frame members for all of its vibratory screen boxes of differing shapes and dimensions. Also, replacement of metal frame members is time consuming both in the assembly of the frame members themselves and in their attachment to the screening vibratory box support structure. Moreover, individual rod block and rod assemblies cannot be removed without disassembly of the metal frame member from within the vibratory screen box. This results in an inordinate amount of production downtime. Finally, the use of metal frame members causes several further problems. On the one hand, they suffer from a substantial wear problem which results from the flow of the aggregate material during the screening process. Accordingly, the need remains for a system which permits the effective and efficient replacement of the screening system, which provides for low cost, fast, convenient and nondestructive replacement of finger screens within the confines of the vibratory screening box.

SUMMARY OF THE INVENTION

The above-described needs have been met by the systems and methods of the present invention each of which comprises an effective and efficient means for screening particulate materials typically plagued by plugging problems.

The method and system of the present invention provides for fast, convenient and low cost installation and replacement of finger screens for screening particulate material on a vibrating or static screening assembly. The subject system includes an integral screening module designed for direct attachment to and removal from the screening assembly without the need to detach or disassemble the support structure (to which the screening modules are attached) from the screening assembly. Thus, screening modules can be readily removed and replaced without expending substantial downtime in completing system maintenance.

The subject invention relates to a screening system, preferably a finger screening system, for screening particulate material. The screening system for screening particulate material comprises a screening assembly including a housing comprising a rear portion and a pair of side walls joined to each other and defining an interior screening chamber. Horizontally-extending support members are located within the confines of the interior screen chamber and are joined to the housing for supporting a plurality of screening modules attached to the horizontally-extending support members. The screening assembly has a longitudinally-extending axis and a laterally-extending axis.

A plurality of screening modules are mounted for direct attachment to and removal from the screening assembly. This is accomplished without the need to detach or disassemble the horizontally-extending support members from the screening assembly. Each screening module comprises a support block having a front end and a back end and a plurality of rods joined at a first end to the front end of the support block. The second end of the rods are free of attachment and form a row of the rods and are typically arranged substantially parallel to each other and extending outwardly from the support block. Preferably, the first end of the rod is bent to facilitate interlocking engagement of the rod within the support block. The row of rods define an array of sieve openings of a predetermined size for allowing particulate material up to a predetermined size to pass through the screening module. The rods are preferably straight but can also be crimped to form a wavy, bent or pinched configuration. The rods can be structurally reinforced by tying together adjacent rods using connecting ties such as wires or the like. These connecting ties extend across the sieve openings and are joined at their respective ends to a pair of adjacent rods. The connecting ties and rods together define an array of discontinuous sieve openings of a predetermined width and length for allowing particulate material of up to a predetermined width and length to pass through the screening module.

A plurality of attachment assemblies are also provided for clamping the plurality of screening modules to the screening assembly. Each attachment assembly comprises a first clamping member and second clamping member which are disposed for relative movement one with respect to other. Clamping of the screening modules within the screening assembly is implemented by moving at least one of the first clamping member and second clamping member along a path toward the rear portion of the screening assembly until the screening modules become interlockingly engaged by the first clamping member and second clamping member. Unclamping of the screening modules from the screening assembly is implemented by moving at least one of the first clamping member and second clamping member in a path away from the rear portion of the screening assembly until the screening modules become disengagable from the first clamping member and second clamping member.

The first clamping member is preferably maintained in a fixed position with respect to the screening assembly. The second clamping member is preferably movable in a path toward the rear portion of the screening assembly for clamping the screening modules between the first clamping member and second clamping member, and in a path away from the rear portion of the screening assembly for unclamping the screening modules located between the first clamping member and second clamping member. Typically, the first clamping member comprises a bearing rail having a vertical-extending plate section including an upper and a lower end, and a horizontal-extending leg section joined to the upper end of the vertical-extending plate section. More preferably, the vertical-extending plate section and the horizontal-extending leg section together form an angle which is less than 90 degrees, most preferably from about 70 up to about 85 degrees. The second clamping member is preferably a clamping member, having a generally U-shaped cross-sectional configuration. The second clamping member typically comprises a base section and an upper and lower side section joined to the respective ends of the base section to form the generally U-shaped configuration. More preferably, the upper side section and the base section of the second clamping member together form an angle which is more than 90 degrees, and most preferably from about 95 up to about 110 degrees. Most preferably, the upper side section and the base section of the second clamping member together form an angle which is complementary.

In a preferred form of the present invention, the front end of the support blocks are narrower than the back end of the support blocks so that the cross-section of the support block widens from the front face to the rear face. More preferably, the support block has a trapezoidal cross-sectional configuration wherein the top face of the support block extends upwardly, and the bottom face of the support block extends downwardly, from the front face to the rear face of the support block. Typically, the support block is fabricated of a polymeric material, typically a polymeric material which is elastomeric in nature. It is desirable that the polymeric material be deformable so that when the support blocks are interlockingly engaged by the first clamping member and second clamping member, clamping of the support blocks will be facilitated, and detachment of the support blocks from engagement by the first and second clamping members will not occur despite the high dynamic stresses exerted by the particulate separation operations.

The screening system of this invention can provide means for adjusting the angle of inclination of the rods with respect to the screen feed conveying direction. In a preferred embodiment, terminal end plates are provided at the respective ends of the attachment assembly. More specifically, the end plates at the ends of the attachment assemblies are connected at three points, typically by fasteners such as screws or bolts, to each of the side walls of the screening assembly. Two of the fasteners passing through elongated holes in the end plates which are located on a circular arc with respect to the third fastener. In this way it is possible to adjust the inclination of the rods in the screen feed conveying direction.

The foregoing and other objects, features and advantages of the invention will become more readily apparent from the following detailed description of a preferred embodiment which proceeds with reference to the drawings.

DETAILED DESCRIPTION OF A PREFERRED EMBODIMENT

Figure 1:
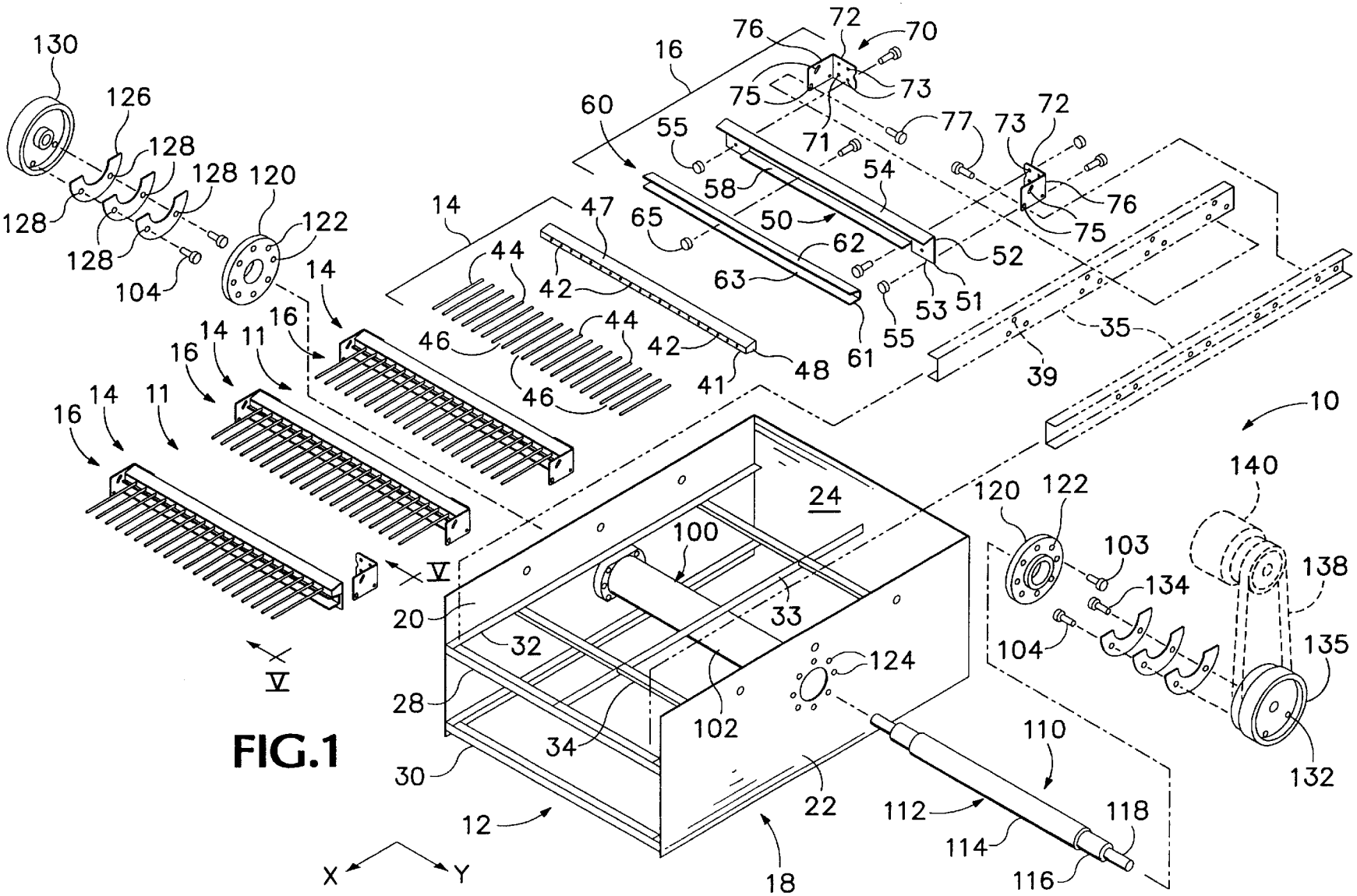
FIG. 1 is a perspective, exploded view of a screening system of the present invention designed for attachment to a vibrating screening assembly, including a perspective, exploded view of an eccentric mechanism for producing a vibrating action.

Referring now to FIG. 1, a finger screening system denoted "10", comprises a vibrating screen assembly, denoted generally "12", screening modules 14, and attachment assemblies 16, respectively. Vibrating screen assembly 12 comprises a longitudinal axis extending in the direction of the arrows denoted "X", and a lateral axis extending in the direction of the arrows denoted "Y".

The vibrating screen assembly 12 depicted in FIG. 1 comprises first and second longitudinally-extending elongate sidewalls 20 and 22 which are vertically arranged and substantially parallel to each other, and laterally-extending elongate rear wall 24 which is vertically arranged and is substantially perpendicular to sidewalls 20 and 22. One end of each of the first and second sidewalls 20 and 22 is joined to the respective ends of rear wall 24 to define a rectangularly-shaped housing 18 therewithin. First and second sidewalls 20 and 22 and rear wall 24 typically comprise elongate flat metal plates and are joined together by conventional welding or mechanical fastening techniques.

The structural integrity of vibrating screen assembly 12 is reinforced by attaching a pair of structural mounting supports to the inner surfaces of first and second sidewalls 20 and 22 and rear wall 24 within housing 18. More specifically, the structural mounting support depicted herein includes an upper structural mounting support 28 and a lower structural mounting support 30. More specifically, upper and lower structural mounting supports 28 and 30 comprise longitudinally-extending structural members 32 and laterally extending structural mounting supports 34 which are joined one to the other and also to the inner surface of first and second sidewalls 20 and 22 and rear wall 24. Additionally, the upper structural support frame 28 includes longitudinally-extending support bar 33 which is attached at one end to the inner surface of rear wall 24 and at the other end and at an intermediate point to laterally-extending structural mounting supports 34.

A system "100" for vibrating the screening modules 14 is depicted in FIG. 1. System 100 comprises an eccentric drive shaft housing 102 which is joined by fasteners 103 to sidewalls 20 and 22. A conventional eccentric mechanism 110 is housed within the confines of eccentric drive shaft housing 102. This eccentric mechanism typically comprises a central drive shaft 112 having a central section 114, an intermediate section 116, and an end section 118. Section 116 is of a narrower diameter than section 114, and section 118 is of a narrower diameter than section 116. Furthermore, short end sections 118 are of a narrower diameter than intermediate sections 116, and intermediate sections 116 are of a narrower diameter than long central section 114. A pair of bearing housing flange assemblies 120, having a plurality of ball bearings contained therein, are mounted onto short intermediate sections 116. The bearing housing flange assemblies 120 include a plurality of apertures 122, which are patterned to align with corresponding apertures 124 located in sidewalls 20 and 22, are attached to sidewalls 20 and 22 and to housing 120 by fasteners 104. Eccentric counterweights 126, with apertures 128 located therewithin, are mounted on intermediate sections 116, and are offset to provide eccentric vibration for screen module 14. The balance wheels 130 and 135 include apertures 132, which are patterned to align with corresponding apertures 128 located in counterweights 126, the balance wheels 130 and 135, and the counterweights 126, are connected to each other by set screws 104. The balance wheel 135 includes a driven sheave about which a pulley belt 138 is connected, the pulley belt 138 also being disposed about a drive motor 140 for providing rotary power to the eccentric mechanism.

The vibrating screen assembly 12 can include longitudinally-extending attachment rails 35. The longitudinally-extending attachment rails 35 of finger screening system 10 define a series of openings 38 for use in indirectly connecting attachment brackets 70 to sidewalls 20 and 22. If the rails 35 are not used, attachment brackets 70 are connected directly to sidewalls 20 and 22. If attachment rails 35 are employed, they are bolted or clamped onto longitudinally-extending structural members 32. Rails 35 also have holes 38 located therewithin for use in connecting attachment assemblies to sidewalls 20 and 22.

System 10 is employed for screening particulate matter according to size employing screen modules 14. Modules 14 comprise elongate support blocks 40, preferably fabricated from a polymeric material, and more preferably a deformable polymeric material such as an elastomeric material. Typical materials for use as support blocks 40 include polyurethane, SBR or natural rubber. The front face 41 of support block 40 defines a plurality of holes 42 arranged in a substantially horizontal, laterally-extending row. One of the ends 43 of each of a plurality of cylindrical rods 44 is attached within the holes 42 to form a row of laterally-extending rods arranged in a horizontal plane and extending outwardly from front face 41 of the support block 40. To facilitate engagement of rod 44 within hole 42, the end 43 is fabricated with a bend therewithin. The row of rods 44 define an array of sieve openings 46 of a predetermined size for allowing particulate matter of up to a predetermined size to pass through the screening module 14.

In addition to front face 41, the support block 40 also includes a top face 47, a bottom face 48 and a rear face 49. The top surface 47 of the support block 40 and the angle formed by the vertical-extending plate section 51 and horizontal-extending leg section 54 are complimentary one to the other. Also, the bottom surface 48 of support block 40 and the angle formed by the upper side section 62 and the base section 61 are complementary one to the other. Both of these complementary configurations are designed to facilitate interlocking engagement between screening module 14 and attachment assembly 16.

Figure 5:
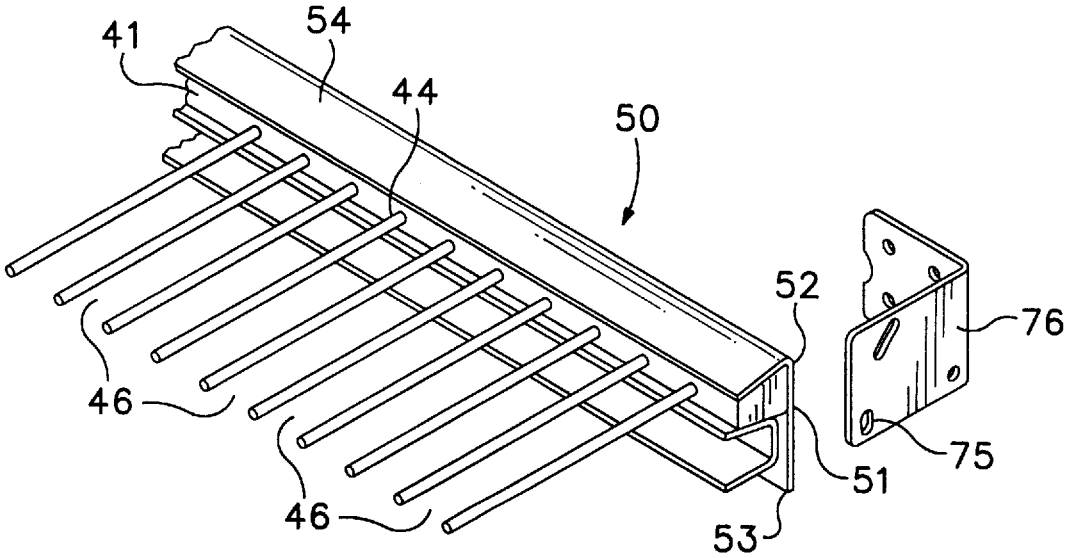
FIG. 5 is an enlarged, perspective, exploded fragmentary view taken along line V—V of FIG. 1, of the end portion of an attachment assembly and a screening module.

Finger screening system 10 also includes attachment assemblies 16 for removably joining the screening modules 14 to vibrating screening assembly 12. As shown in FIGS. 1 and 5, each attachment assembly 16 comprises a bearing rail 50 and a clamping member 60, the bearing rail 50 and clamping member 60 together securely and interlockingly holding screening module 40 in place during the particulate material screening operation, and an attachment bracket 70 for connecting the attachment assembly 16 to sidewalls 20 and 22.

Bearing rail 50 comprises a vertical-extending plate section 51 including an upper and a lower end 52 and 53, and horizontal-extending leg sections 54 and 58 joined to the respective upper and lower ends 52 and 53. Bearing rail 50 is fixed in position by connection to attachment bracket 70 employing fasteners 55. The vertical-extending plate section and the horizontalextending leg section together form an angle which is less than 90 degrees, and typically about 80 degrees.

The clamping member 60 has a generally U-shaped cross-sectional configuration and typically comprises a base section 61 and an upper and lower side sections 62 and 63 which are joined to the respective ends of the base section to form the generally U-shaped configuration. The upper side section 62 and the base section 61 of the clamping member 60 together form an angle which is more than 90 degrees, and preferably about 100 degrees. The angle formed by upper side section 62 and the base section 61 is complementary to the angle formed by the top surface 47 of the support block 40 for facilitating interlocking engagement between bearing rail 50 and screening module 40. Attachment brackets 70 are provided for connecting screening module 14 and attachment assembly 16 to system 10. Attachment brackets comprise rear plate members 72 joined at one end to one end of side plate members 76. Rear plate member 72 includes openings 73 for connection to bearing rail 50 and clamping member 60 using fasteners 55 and 65, and side plate members 76 include openings 75 for connecting attachment brackets, and in turn screening module 14 and attachment assembly 16, to sidewalls 20 and 22. Fastener 65 passes through hole 71 in each of the attachment brackets 70.

Figure 2:
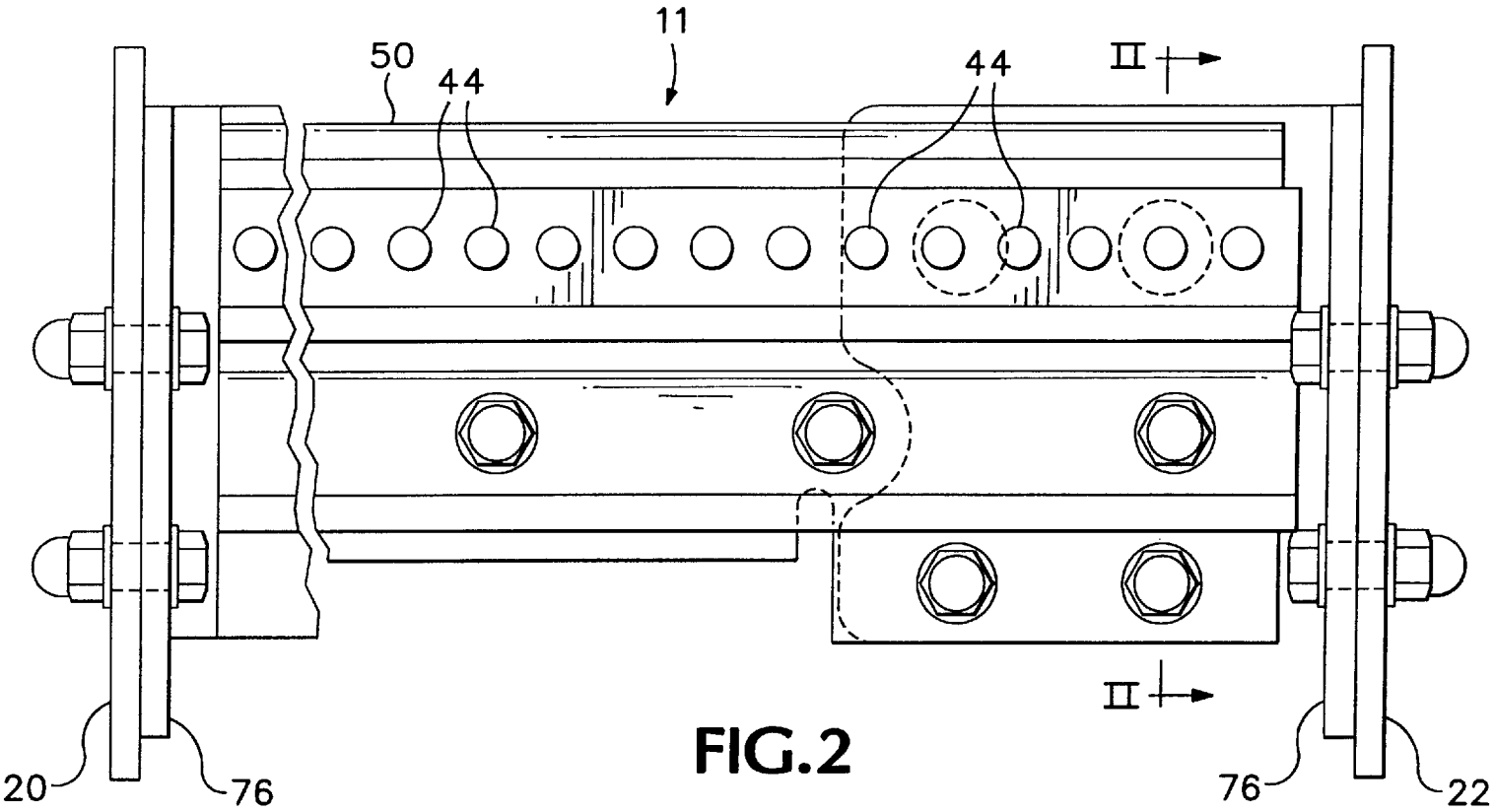
FIG. 2 is an enlarged, fragmentary front view of the end sides of the rods of a screening module of the present invention.
Figure 3:
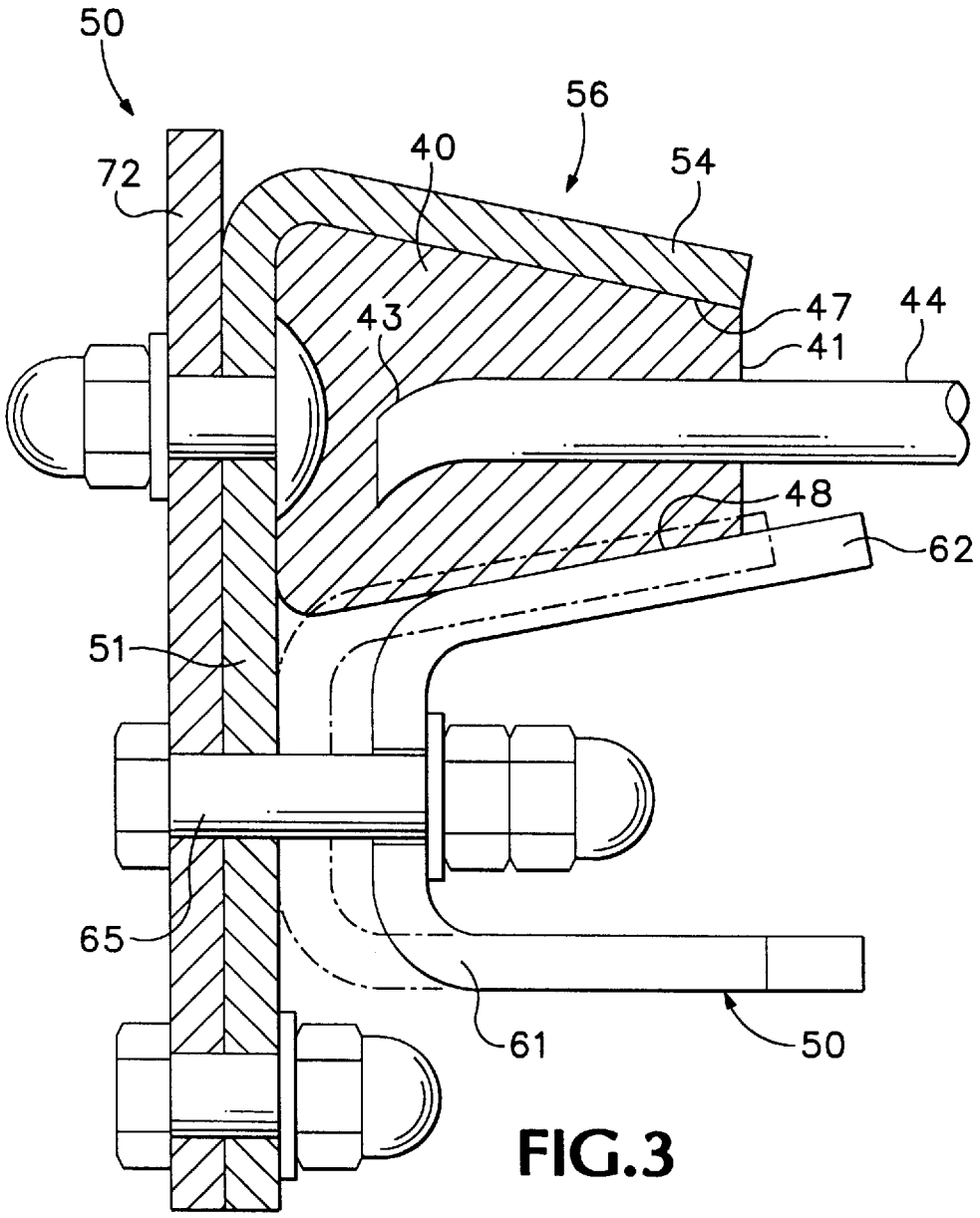
FIG. 3 is a view taken along line II—II of FIG. 2.
Figure 4:
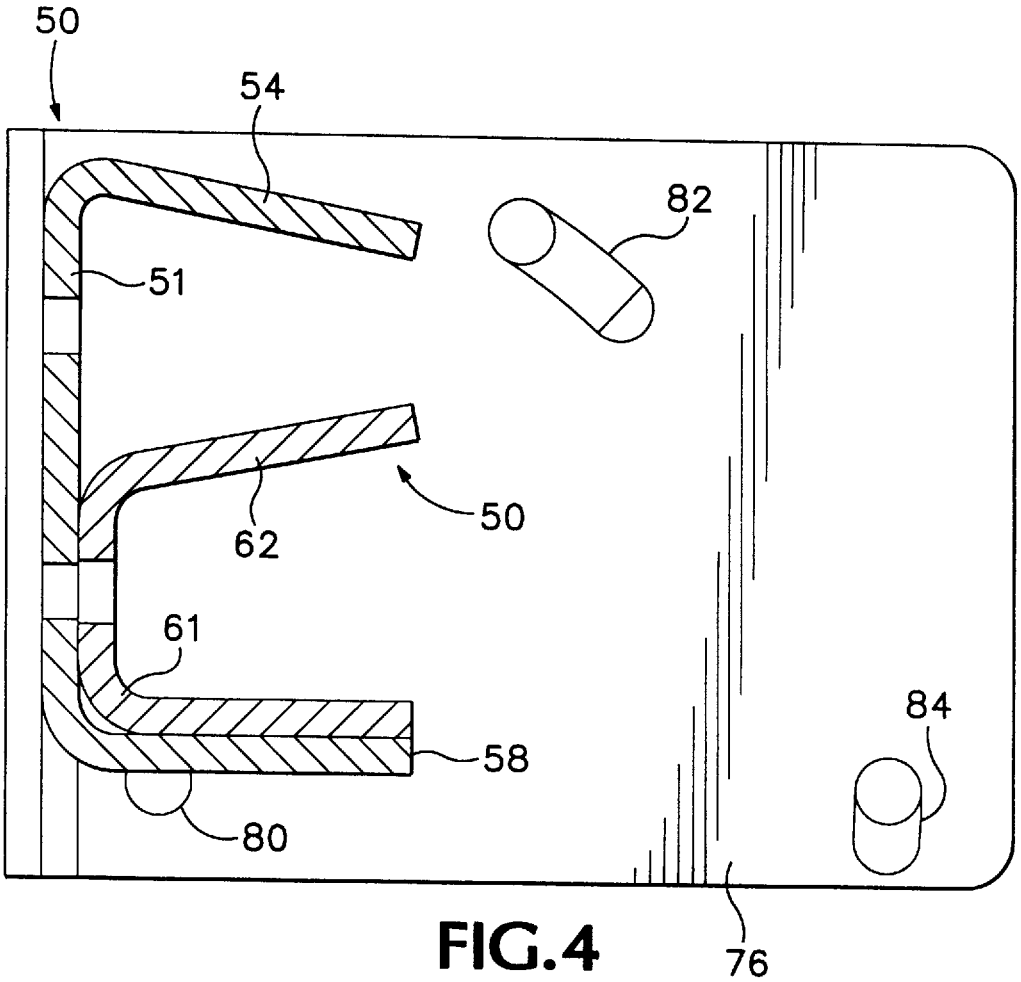
FIG. 4 is a fragmentary end view in the vicinity of the terminal end plates of the bearing rail.

As more specifically shown in FIGS. 2–4, between parallel sidewalls 20 and 22, the screening assembly 10 has several finger screen areas 11 arranged successively in the screening direction. FIG. 2 diagrammatically shows such a finger screen area 11 in a view of the rods 44. The rods 44 are arranged in parallel and equidistantly on a bearing rail 50, which is fixed by terminal end plates 76 to sidewalls 20 and 22.

As shown in FIG. 3, each bearing rail 50 comprises an angle section 56 which has an upper, shorter leg 54 and a substantially upright, longer leg 51. The angle between the upper leg 54 and the upright leg 51 is less than 90 degrees, so that the upper leg 54 is somewhat downwardly bent.

The rods 44 are embedded in elastomeric elongate support block 40, which have a trapezoidal cross-sectional configuration. Their top and bottom facing surfaces 47, 48 consequently diverge in the direction towards the upright, long leg 51 of the angle section 50. In order to secure the rods 44 in a positive manner in the elastomeric elongate support block 40, their ends 43 are, as specifically shown in FIG. 3, bent transversely to the rod axis.

For fitting the elastomeric elongate support block 40 with the rods 44 is provided a U-shaped clamping member 60, whose web 61 is approximately parallel to the long leg 51 of the angle section and whose upper leg 62 is slightly outwardly bent. This upper leg 62 is fixed by means of a fastener 65, in the form of a double nut and bolt assembly having a washer disposed between the nut and the inner surface of the web 61, to an angle section 50 and then to additional rear support plate 72. By tightening the fastener 65 the elastomeric elongate support block 40 is secured under pretension between the upper leg 54 of the angle section 51 and the upper leg 62 of the clamping section 60. In the end position shown in dot-dash line manner the elastomeric elongate support block 40 is deformed to such an extent that a detachment is not possible despite the high dynamic stresses. However, the elastic mounting of the rods 44 is maintained, so that in particular on the free end side 41 of the elastomeric elongate support blocks 40 excessive gravitational forces do not act on the rod 44.

As specifically shown in FIG. 4, in order to be able to vary the inclination of the rods 44 in the screen feed conveying direction, the terminal end plates 76 are fixed by means of three fasteners (not shown) to the sidewalls 20 and 22. The bearing rail with side plate members 76, which is fixed by means of a three-point fixture to the side plate members 76, can be positioned so that the rods have the desired inclination position with respect to the conveying direction, in order to influence the residence time of the screen feed on the finger screen area. For this purpose the side plate members 76 have a circular hole 80, and two elongated holes 82 and 84, whose axis describes a circular arc around the hole 80. The rods 44 can be moved to a plurality of angular positions by adjusting the support blocks 40 by moving same with the elongated holes 82 and 84.

Fasteners 55 and 65, typically in the form of a screw or a bolt and nut arrangement, are employed to respectively connect bearing rail 50 and attachment bracket 70, as well as bearing rail 50 and clamping member 60.

A screen assembly similar to that which is shown in FIG. 1 can also be provided which comprises a static screening system. In a static screening system the particulate material is fed to screen in the manner depicted in FIG. 1 except that the particulate material is moved by gravity along a downwardly-descending set of screen modules, and is not assisted by the vibrating action of vibratory system 100.

Having illustrated and described the principles of my invention in a preferred embodiment thereof, it should be readily apparent to those skilled in the art that the invention can be modified in arrangement and detail without departing from such principals. I claim all modifications coming within the spirit and scope of the accompanying claims.

We claim:

1. A screening system for screening particulate material comprising:

a screening assembly including a housing defining an interior screening chamber having a front portion and a rear portion, and horizontally-extending support members located within the confines of the interior screen chamber and joined to the housing for supporting a plurality of screening modules attached to the horizontally-extending support members;

a plurality of screening modules mounted for attachment to and removal from the screening assembly without the need to detach or disassemble the horizontally-extending support members from the housing, each screening module comprising a support block having a front end and a back end and a plurality of rods joined at a first end to the front end of the support block, the second end of the rods being free of attachment and forming a row of the rods extending outwardly from the support block, the row of rods defining an array of sieve openings of a predetermined size for allowing particulate material up to a predetermined size to pass through the screening module; and a plurality of attachment assemblies for clamping the plurality of screening modules to the screening assembly, each attachment assembly comprising a first clamping member and second clamping member which are disposed for relative movement one with respect to the other, clamping of said screening modules within said screening assembly being affected by moving at least one of said first clamping member and second clamping member along a path toward said rear portion of said screening chamber until said screening modules become interlockingly engaged by said first clamping member and second clamping member, and unclamping of said screening modules from said screening assembly being affected by moving at least one of said first clamping member and second clamping member in a path away from said rear portion of said screening chamber until said screening modules become disengagable from said first clamping member and second clamping member, the first clamping member being maintained in a fixed position with respect to the screening assembly and the second clamping member being movable in a path toward the rear portion of said screening assembly for clamping said screening modules between said first clamping member and second clamping member and in a path away from the rear portion of said screening assembly for unclamping said screening modules located between said first clamping member and second clamping member. said first clamping member comprising a bearing rail including a vertical-extending plate section including an upper and a lower leg, and a horizontal-extending leg section joined to the upper end of said vertical-extending plate section. said vertical-extending plate section and said horizontal-extending leg section together forming an angle which is less than 90 degrees.

2. A screening system according to claim 1, wherein the front end of the support blocks are narrower than the back end of the support blocks so that the cross-section of the support block widens from the front end to the back end.

3. A screening system according to claim 1, wherein said second clamping member is generally U-shaped clamping member which comprises a base section and a pair of side sections joined to the respective ends of said base section.

4. A screening system according to claim 1, wherein the support block has a trapezoidal cross-sectional configuration.

5. A screening system according to claim 1, wherein the angle of inclination of the rods is adjustable in the direction of flow of the particulate material.

6. A screening system according to claim 1, wherein the first end of the rod is bent to facilitate interlocking engagement of the rod within the support block.

7. A screening system according to claim 6, wherein the support block is made of a polymeric material which is deformable when interlockingly engaged by said first clamping member and second clamping member to such an extent that a detachment is not possible despite the dynamic stresses.

8. A method for screening particulate material comprising:

providing a screening assembly including a housing defining an interior screening chamber, and horizontally-extending support members located within the confines of the interior screen chamber and joined to the housing for supporting a plurality of screening modules attached to the horizontally-extending support members;

providing a plurality of screening modules, each screening module comprising a support block having a front end and a back end and a plurality of rods joined at a first end to the front end of the support block, the second end of the rods being free of attachment and forming a row of the rods extending outwardly from the support block, the row of rods defining an array of sieve openings of a predetermined size for allowing particulate material up to a predetermined size to pass through the screening module;

mounting said screening modules to said screening assembly, said mounted screening modules being directly attachable to and removable from the screening assembly without the need to detach or disassemble the horizontally-extending support members from the housing;

clamping the plurality of screening modules to the screening assembly using a plurality of attachment assemblies, each attachment assembly comprising a first clamping member and second clamping member which are disposed for relative movement one with respect to the other, by moving at least one of said first clamping member and second clamping member along a path toward a rear portion of said screening assembly until said screening modules become interlockingly engaged by said first clamping member and second clamping member; and unclamping said screening modules from said screening assembly by moving at least one of said first clamping member and second clamping member in a path away from the rear portion of said screening assembly until said screening modules become disengagable from said first clamping member and second clamping member;

providing said first clamping members in a fixed position with respect to the screening assembly and the second clamping member, moving said second clamping member in a path toward the rear portion of said screening assembly, clamping said screening modules between said first clamping member and second clamping member, and if required. unclamping said screening modules located between said first clamping member and second clamping member by moving said second clamping member in a path away from the a rear portion of said screening assembly; and providing said first clamping member comprising a bearing rail including a vertical-extending plate section having an upper and a lower leg. and a horizontal-extending leg section joined to the upper end of said vertical-extending plate section, and said vertical-extending plate section and said horizontal-extending leg section together forming an angle which is less than 90 degrees.

9. A method according to claim 8, which includes the further step of providing support blocks having a front end which is narrower than the back end of the support blocks so that the cross-section of the support block widens from the front end to the back end.

10. A method according to claim 8, wherein said second clamping member is a generally U-shaped clamping member which comprises a base section and a pair of side sections joined to the respective ends of said base section.

11. A method according to claim 8, wherein the support block has a trapezoidal cross-sectional configuration.

12. A method according to claim 8, wherein the angle of inclination of the rods is adjustable in the direction of flow of the particulate material.

13. A method according to claim 8, wherein the first end of the rod is bent to facilitate interlocking engagement of the rod within the support block.

14. A method according to claim 8, wherein the support block is made of a polymeric material which is deformable when interlockingly engaged by said first clamping member and second clamping member to such an extent that a detachment is not possible despite high dynamic stresses.

15. A screening system for screening particulate material comprising:

a screening assembly including a housing defining an interior screening chamber, and horizontally-extending support members located within the confines of the interior screening chamber and joined to the housing for supporting a plurality of screening modules attached to the horizontally-extending support members;

a plurality of screening modules elastically mounted for direct attachment to and removal from the screening assembly without the need to detach or disassemble the horizontally-extending support members from the housing, each screening module comprising an elastic support block having a front end and a back end wherein the front end of the support blocks are narrower than the back end of the support blocks so that the cross-section of the support block widens from the front end to the back end, and a plurality of rods joined at a first end to the front end of the support block, the second end of the rods being free of attachment and forming a row of the rods extending outwardly from the support block, the row of rods defining an array of sieve openings of a predetermined size for allowing particulate material up to a predetermined size to pass through the screening module; and a plurality of attachment assemblies for clamping the plurality of screening modules to the screening assembly, each attachment assembly comprising a first clamping member and second clamping member which together form a clamping chamber which engages and interlockingly retains the support blocks during screening of the particulate material, the first clamping member being maintained in a fixed position with respect to the screening assembly and the second clamping member being movable in a path toward a rear portion of said screening assembly for clamping said screening modules between said first clamping member and second clamping member until said screening modules become interlockingly engaged by said first clamping and second clamping member, and a second clamping member movable in a path away from the rear portion of said screening assembly for unclamping said screening modules located between said first clamping member and the second clamping member until said screening modules become disengagable from said first clamping member and second clamping member, said first clamping member comprising a bearing rail including a vertical-extending plate section having an upper and a lower end. and a horizontal-extending leg section joined to the upper end of said verticalextending plate section, the vertical-extending plate section and said horizontal-extending leg section together forming an angle which is less than 90 degrees. the horizontal-extending leg section having an inner surface and the support block having a top surface which are complementary one to the other.

16. A screening system according to claim 15, wherein said screen modules are disposed in a cascading arrangement for effectively and efficiently screening the particulate material.

17. A screening system according to claim 15, which further includes end plates attached to the side walls of the housing each having a circular hole and two elongated holes whose axis describes a circular arc around the circular hole, the angle of inclination of the rods being adjustable.

18. A screening system according to claim 15, wherein the angle of inclination of the rods is adjustable in the direction of flow of the particulate material.

19. A screening system according to claim 15, wherein the support block has a trapezoidal cross-sectional configuration.

20. A screening system according to claim 19, wherein a polymeric material is deformable when interlockingly engaged by said first clamping member and second clamping member.

21. A screening system according to claim 5, wherein said second clamping member is a generally U-shaped clamping member which comprises a base section and upper and lower side sections joined to the respective ends of said base section, the upper side section having an outer surface and the support block having a bottom surface which are complementary one to the other.

22. A screening system according to claim 21, wherein the support block has a trapezoidal cross-sectional configuration.

23. A screening system according to claim 22, wherein the support block is made of a polymeric material which is deformable when interlockingly engaged by said first clamping member and second clamping member.

* * * * *